United States Patent [19]

Newman

[11] 3,994,493

[45] Nov. 30, 1976

[54] BOWLING ACCESSORY DEVICE

[75] Inventor: Martin Newman, Hicksville, N.Y.

[73] Assignee: The Raymond Lee Organization, Inc., New York, N.Y. ; a part interest

[22] Filed: Oct. 23, 1975

[21] Appl. No.: 624,876

[52] U.S. Cl. ..... 273/54 B; 2/21; 128/87 A; 128/88

[51] Int. Cl.[2] ..... A63B 71/14

[58] Field of Search ..... 273/54 B; 2/21, 161 A; 128/87 A, 88

[56] References Cited

UNITED STATES PATENTS

| | | | |
|---|---|---|---|
| 1,375,507 | 4/1921 | Grundmann | 128/83 |
| 2,528,456 | 10/1950 | Stevenson | 128/87 A |
| 2,732,555 | 1/1956 | Paisley | 273/54 B UX |
| 3,011,171 | 12/1961 | Pell | 128/88 X |
| 3,421,761 | 1/1969 | Grant | 273/54 B |

*Primary Examiner*—Anton O. Oechsle
*Attorney, Agent, or Firm*—Daniel Jay Tick

[57] ABSTRACT

A bowling accessory device for preventing two inner sections of a bowling finger from assuming a straight line comprises a strip-like member with a first ring-like member affixed to the member at a first end thereof and removably accommodating a section of a bowling finger. A second ring-like member is affixed to the second opposite end of the strip-like member and removably accommodates next-adjacent section of the bowling finger. An adjusting member adjustably affixed to the second ring-like member selectively varies the distance between the first and second ring-like members at their sides opposite the strip-like member thereby preventing the sections of the finger in the ring-like members from assuming a straight position.

5 Claims, 2 Drawing Figures

BOWLING ACCESSORY DEVICE

DESCRIPTION OF THE INVENTION

The present invention relates to a bowling accessory device. More particularly, the invention relates to a bowling accessory device for preventing the two inner sections of a bowling finger from assuming a straight position.

Objects of the invention are to provide a bowling accessory device of simple structure, which is inexpensive in manufacture, is easy and convenient to install on a finger and remove therefrom and functions with efficiency, effectiveness and reliability to prevent the two inner sections of a bowling finger from assuming a straight position. The device of the invention prevents the middle finger of the bowling hand from being straightened beyond the position where it has the proper shape or angle to provide the desired lift and spin to the bowling ball.

In order that the invention may be readily carried into effect, it will now be described with reference to the accompanying drawing, wherein.

Figure 1:
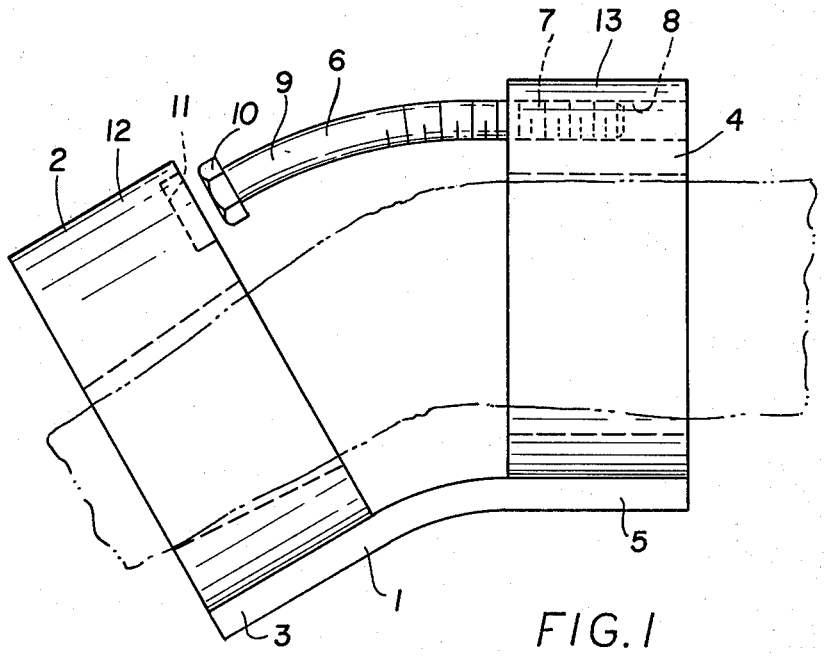
FIG. 1 is an embodiment of the bowling accessory device of the invention.
Figure 2:
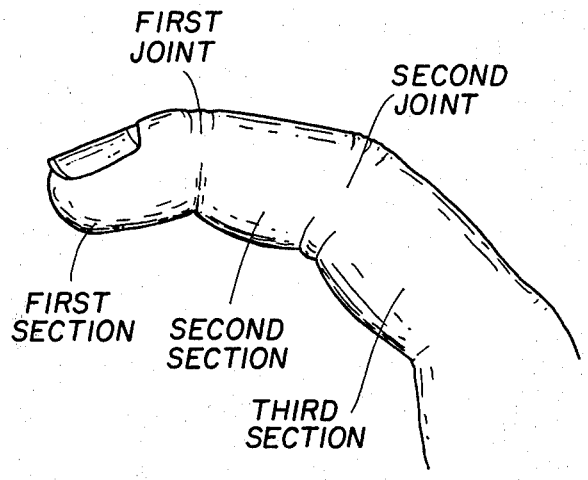
FIG. 2 is a view of a finger identifying the parts thereof referred to herein.

The bowling accessory device of the invention prevents the two inner sections of a bowling finger from assuming a straight position. The bowling accessory device of the invention comprises a substantially flexible strip-like member 1. A first ring-like member 2 is affixed to a first end 3 of the member 1. A second ring-like member 4 is affixed to the second opposite end 5 of the member 1.

The strip-like member 1 comprises any suitable flexible material such as, for example, leather or plastic. The members 2 and 4 are affixed to the strip-like member 1 by any suitable means such as, for example, adhesive or rivets, and comprise any suitable material such as, for example, plastic.

A screw-type member 6 is movably affixed to the ring-like member 4 for varying the selected angle between the members 2 and 4. The adjusting member 6 is a substantially arcuate screw type member screwed at one end 7 thereof in an internally threaded bore 8 in the ring-like member 4. The other end 9 of the adjusting member 6 has a head 10 which is free from, and abuts, the ring-like member 2.

A recess 11 is formed in the ring-like member 2 for accommodating the head 10 of the adjusting member 6 when said head abuts said ring-like member.

The bowling accessory device of the invention is placed on the middle finger of the bowling hand, so that the second ring-like member 4 fits on the third section of the finger and the first ring-like member 2 fits on the second section of the finger.

The adjusting member 6, which may comprise plastic, for example, is manually rotated about its axis at its threaded part to selectively vary the distance that it extends from the ring-like member 4, thereby varying the distance between the parts 12 and 13 of the ring-like members 2 and 4. The strip-like member 1 functions somewhat like a hinge between the ring-like members 2 and 4.

In order to vary the distance, or adjust for the desired angle, between the parts 12 and 13 of the members 2 and 4, the user rotates the adjusting member 6 in either direction about its axis. This is accomplished in increments of full turns, so that the head 10 of the adjusting member 6 returns to the accommodating recess 11 in the ring-like member 2. Since the adjusting member 6 is not affixed to the ring-like member 2, but merely abuts it, as hereinbefore mentioned, the middle finger may be closed, but cannot be opened beyond the adjusted extent.

While the invention has been described by means of a specific example and in a specific embodiment, I do not wish to be limited thereto, for obvious modifications will occur to those skilled in the art without departing from the spirit and scope of the invention.

I claim:

1. A bowling accessory device for preventing two inner sections of a bowling finger from assuming a straight position, said bowling accessory device comprising a flexible strip-like member;

a first ring-like member affixed to a first end of the strip-like member and removably accommodating a section of a bowling finger;

a second ring-like member affixed to a second opposite end of the strip-like member and removably accommodating the next-adjacent section of the bowling finger; and an adjusting member adjustably affixed to one of the ring-like members for selectively varying the distance between the ring-like members at their parts opposite the strip-like member thereby preventing the finger sections in the ring-like members from assuming a straight line.

2. A bowling accessory device as claimed in claim 1, wherein the ring-like members are spaced annular members.

3. A bowling accessory device as claimed in claim 1 wherein the second ring-like member has an internally threaded bore therein and wherein the adjusting member comprises a screw type member screwed at one end in the bore of the second of the ring-like members and abutting at its other end the first of the ring-like members, said adjusting member being independent from said first ring-like member.

4. A bowling accessory device as claimed in claim 3, wherein the adjusting member is substantially arcuate.

5. A bowling accessory device as claimed in claim 3, further comprising a recess formed in the first of the ring-like members for accommodating the other end of the screw type member.

* * * * *